US006578569B2

(12) United States Patent
Liese

(10) Patent No.: US 6,578,569 B2
(45) Date of Patent: Jun. 17, 2003

(54) CONTROL OR REGULATING DEVICE FOR A STOVE AND METHOD FOR CONTROL

(75) Inventor: Frank Liese, München (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 0 days.

(21) Appl. No.: 10/082,313

(22) Filed: Feb. 25, 2002

(65) Prior Publication Data

US 2002/0129809 A1 Sep. 19, 2002

Related U.S. Application Data

(63) Continuation of application No. PCT/EP00/07648, filed on Aug. 7, 2000.

(30) Foreign Application Priority Data

Aug. 24, 1999 (DE) ..... 199 40 123

(51) Int. Cl.[7] ..... F24C 15/20

(52) U.S. Cl. ..... 126/299 R; 126/299 D; 126/39 G; 219/707; 219/757

(58) Field of Search ..... 126/299 R, 299 D, 126/21 R, 21 A, 39 BA, 39 G; 219/509, 518, 447.1, 446.1, 414, 706, 707, 757; 392/451

(56) References Cited

U.S. PATENT DOCUMENTS

| | | | | |
|---|---|---|---|---|
| 4,352,349 A | | 10/1982 | Yoho | |
| 5,074,281 A | | 12/1991 | Fluhrer et al. | |
| 5,139,009 A | * | 8/1992 | Walsh | 126/299 D |
| 5,140,120 A | * | 8/1992 | Kasai et al. | 126/21 A |
| 5,422,976 A | * | 6/1995 | Knepler | 392/451 |
| 6,170,480 B1 | * | 1/2001 | Melink et al. | 126/299 R |

FOREIGN PATENT DOCUMENTS

| | | |
|---|---|---|
| EP | 0 443 141 A2 | 8/1991 |
| JP | 04 155 131 | 5/1992 |
| JP | 05 231 683 | 9/1993 |

* cited by examiner

*Primary Examiner*—James C. Yeung
(74) *Attorney, Agent, or Firm*—Laurence A. Greenberg; Werner H. Stemer; Ralph E. Locher

(57) ABSTRACT

A control or regulating device of a stove influences (activates, deactivates, controls, regulates) the heat energy of at least one cooking zone of the stove in dependence upon cooking steam. The control device or a sensor device of the control device can be installed at least partly in a fume hood of the stove.

18 Claims, 1 Drawing Sheet

CONTROL OR REGULATING DEVICE FOR A STOVE AND METHOD FOR CONTROL

CROSS-REFERENCE TO RELATED APPLICATION

This application is a continuation of copending International Application No. PCT/EP00/07648, filed Aug. 7, 2000, which designated the United States.

BACKGROUND OF THE INVENTION

FIELD OF THE INVENTION

The invention relates to a control or regulating device for a stove including a cooking field with at least one cooking zone.

The stove is preferably electrically heatable, although the invention can also be used for gas-heated stoves. The cooking zone in a cooking field of an electric stove can be an electric hot plate or one or more electric heating elements under a plate that is made of ceramic or some other heat-resistant material.

When cooking continues after the boiling point is attained, the food or liquid in a vessel on a cooking zone is very frequently heated with too much heat energy. The result is an unnecessarily high energy consumption, frequently more than three times the energy consumption that is actually required, in connection with heavy steam development.

European Patent Application EP 0 443 141 A2, corresponding to U.S. Pat. No. 5,074,281, to Fluhrer et al., teaches a circuit configuration for controlling a fan, particularly in a fume hood above a stove, in dependence upon steam that is drawn to the fan, whereby an ultrasonic system with an ultrasound transmitter and an ultrasound receiver is disposed in front of the fan for measuring the steam quantity and controlling the fan in dependence on the detected steam quantity. This document also discloses how to control the fan (ventilator, blower, or rather their motor) in dependence on the moisture and/or fumes and/or smoke and/or heat flowing through the fume hood, which is detected by a sensor element. The reference also discloses how to control the fan in dependence upon a difference between the temperature of the cooking fumes (steam) and the environmental temperature.

SUMMARY OF THE INVENTION

It is accordingly an object of the invention to provide a control or regulating device for a stove that overcomes the hereinafore-mentioned disadvantages of the heretofore-known devices and methods of this general type and that prevents, in a simple and economical way, an unnecessarily high energy consumption for cooking food and liquids after the boiling point is attained.

With the foregoing and other objects in view, in a stove having a cooking field with at least one cooking zone, there is provided, in accordance with the invention, a controller including a control device connected to the at least one cooking zone, the control device having a steam detector for detecting a level of steam produced at the at least one cooking zone, the control device influencing an amount of heat energy produced by the at least one cooking zone in dependence upon the level of cooking steam detected.

In accordance with another feature of the invention, the control or regulating device is constructed to respond to steam and to influence the heat energy of at least one cooking zone of the cooking field of a stove in dependence upon the steam.

In accordance with a further feature of the invention, the control device cuts off the heat energy when a predetermined steam value is detected.

In accordance with an added feature of the invention, the control device controls the amount of heat energy in dependence upon the level of cooking steam detected.

In accordance with an additional feature of the invention, the control device regulates the amount of heat energy in dependence upon the level of cooking steam detected.

In accordance with yet another feature of the invention, the control device responds to at least one cooking steam value selected from the group consisting of steam quantity/time, steam density, and steam temperature.

In accordance with yet a further feature of the invention, the quantity of steam that results during slow cooking or cooking of food or cooking of liquids is measured and, in dependence on the measured quantity of steam, the heat energy of the appertaining cooking zone is reduced far enough that only the heat energy that is required to maintain the boiling-point temperature continues to be supplied.

In the context of the invention, the phrase measuring the steam quantity does not merely mean the ability to measure the quantity of steam that is generated per unit time, but rather, preferably, a method by which the steam quantity can be indirectly measured, for instance, by detecting the heat and/or the density and/or the flow speed of the steam. Such measurement can be accomplished with the aid of inexpensive temperature sensors, densimeters, flowmeters, or ultrasonic measurement systems that respond as a function of density, which extend straight through the steam path.

In accordance with yet an added feature of the invention, there is provided at least one sensor for sensing the cooking steam. The sensor is disposed above the cooking field in a path of the steam produced by the at least one cooking zone, and the sensor is connected to the control device.

The stove is advantageously constructed such that the heat energy of its cooking zones is individually adjustable with complete freedom or in small increments by the inventive control or regulating device.

The invention has the advantage of achieving a substantial savings of energy.

In accordance with yet an additional feature of the invention, the stove has a fume hood and the sensor is disposed at the fume hood. Preferably, the stove has a fume hood with a fan and the control device and/or the sensor is connected to the fan and automatically activates the fan in dependence upon the level of steam detected.

In contrast to European Patent Application EP 0 443 141 A2, according to the invention, the control or regulating devices of a fume hood can control or regulate not only the fan but also, or instead, the heat energy of one or more cooking zones of a stove that is disposed beneath such a fume hood.

Furthermore, the control or regulating device according to the invention can be constructed to monitor several cooking zones of a cooking field or to monitor several cooking fields. In such a case, the control or regulating device is constructed so that, when several cooking zones are on at the same time, the device finds the cooking zone that is being overheated by performing "test" reductions of the heat energy of several cooking zones in succession. The decision that is made by the control or regulating device can also be reached by tracking the time development of the signals from the moment of activation of the relevant cooking zone, for instance, by measuring the time-dependent steam development or steam temperature development and potentially the time-dependent heat output as well. Other parameters and criteria that can be automatically taken into account by the control or regulating device include the manually activated heat output of the cooking zones and the size of the cooking zones, the time period from the activation of a cooking zone until a specific steam quantity develops or until steam fails to develop, or a rapid or gradual decline in steam development or in the associated steam criteria such as temperature and/or density.

In accordance with again another feature of the invention, the cooking zone is a number of cooking zones, a common sensor is connected to the control device and is associated with the number of cooking zones, and the common sensor automatically detects one of the cooking zones responsible for producing steam exceeding a prescribed steam value based upon prescribed operating criteria, and limits heat energy produced by the one cooking zone.

In accordance with again a further feature of the invention, the common sensor automatically detects one of the cooking zones responsible for producing steam exceeding a prescribed steam value, and limits heat energy produced by serially and selectively reducing heat energy of the cooking zones.

In accordance with again an added feature of the invention, the control or regulating device can optionally be switched on and off manually. In the off state, the stove can be switched on and off manually in conventional fashion and/or controlled or regulated automatically by an internally integrated system.

In accordance with again an additional feature of the invention, the control device has a safety shut-off automatically cutting off heat energy from the at least one cooking zone dependent upon the level of steam detected and upon at least one prescribed safety criterion when the at least one cooking zone exceeds the at least one safety criterion.

In accordance with still another feature of the invention, operational safety is enhanced by measures for detecting hazardous operating situations of the stove and triggering specified safety measures accordingly.

EXAMPLES

Given an abrupt interruption or sharp reduction of the steam quantity despite the relevant cooking zone being on, it can be assumed that the relevant pot or pan has been removed from the stove. In such a case, it can be provided that the heat energy of the relevant cooking zone be automatically shut off by the control or regulating device. Given a slow reduction of the steam quantity and a corresponding decline of the steam signals despite the relevant cooking zone remaining on without any adjustment, it can be inferred that all water or fat has evaporated, for example. The control or regulating device is advantageously constructed such that it detects this kind of slow reduction of fume development where the heat energy has not been reduced, and it turns off the relevant cooking zone. The control or regulating device can be constructed such that it responds to rates of steam change, i.e., the variation per unit time, for example, being provided with an electronic logic.

The inventive control or regulating device is preferably constructed so that, in dependence on the number of respectively active cooking zones and/or their size and/or power stages and/or the signals of the sensor device, and, when combined with the function of a fume hood of a stove, the device switches the fan of the fume hood on or off and/or controls or regulates it. The control or regulating device is preferably constructed so that, given excessive steaming, it reduces the power of the relevant cooking zone until the steaming corresponds to a "normal" or "mild" boil.

Furthermore, the control or regulating device of the stove can also be part of a central electronic control system in a building, i.e., in a system such as a home electronic system.

With the objects of the invention in view, there is also provided a controller for a stove having a cooking field with at least one cooking zone, the controller including a control device connected to the at least one cooking zone, the control device having a steam detector for detecting a level of steam produced at the at least one cooking zone, the control device influencing an amount of heat energy produced by the at least one cooking zone in dependence upon the level of cooking steam detected.

With the objects of the invention in view, there is also provided a method for controlling a stove having a cooking field with at least one cooking zone, including the steps of detecting a level of cooking steam produced from the at least one cooking zone, controlling the at least one cooking zone dependent upon the level of cooking steam detected, and influencing a level of heat energy of the at least one cooking zone in dependence upon the level of cooking steam detected.

Other features that are considered as characteristic for the invention are set forth in the appended claims.

Although the invention is illustrated and described herein as embodied in a control or regulating device for a stove, it is, nevertheless, not intended to be limited to the details shown because various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

BRIEF DESCRIPTION OF THE DRAWINGS

The FIGURE is a partially cross-sectional front view of a control or regulating device of a cooking stove in combination with a fume hood that is disposed above the cooking field of the stove according to the invention.

DESCRIPTION OF THE PREFERRED EMBODIMENTS

Figure 1:
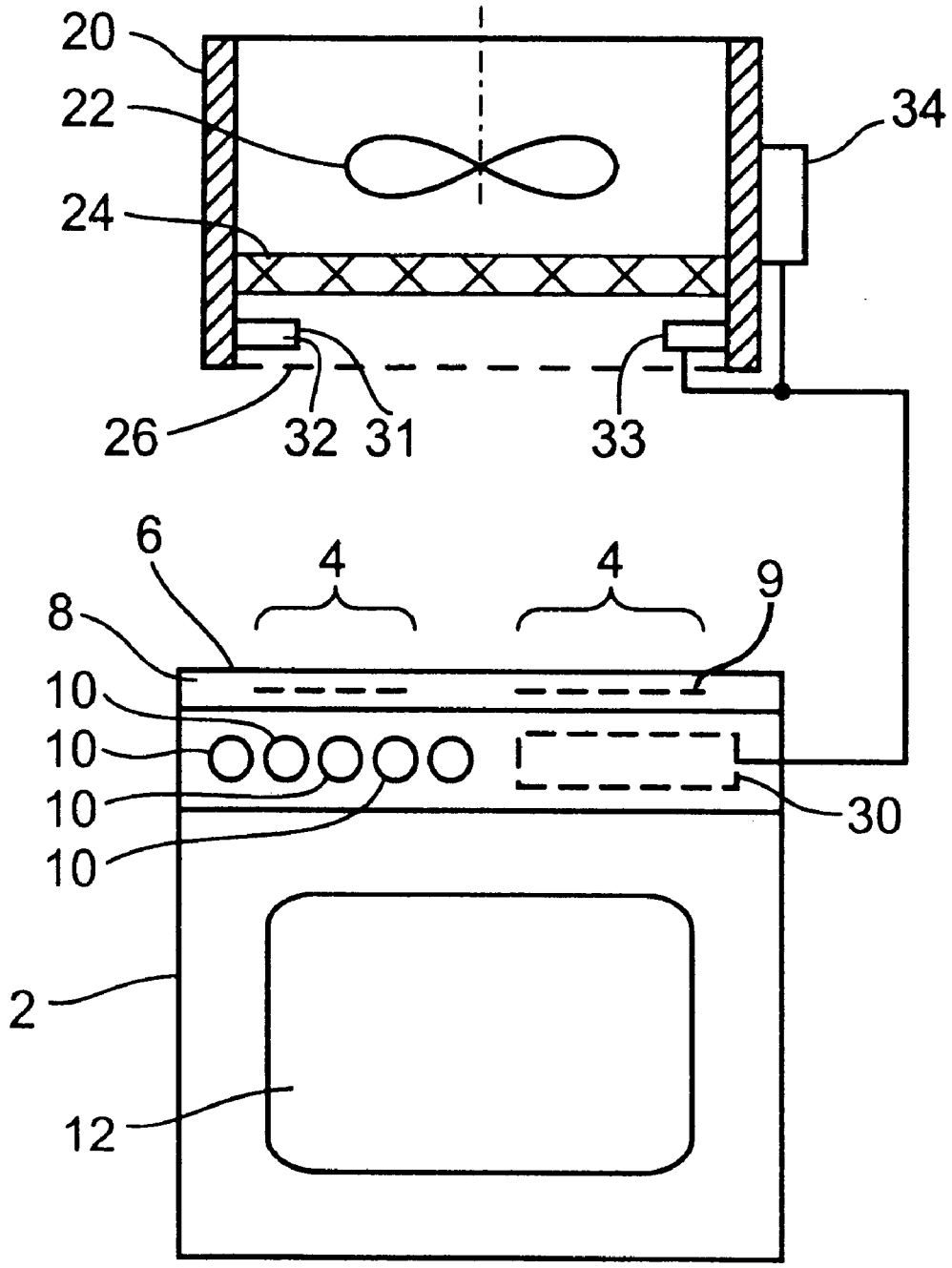

Referring now to the single FIGURE of the drawing, it is seen that an electric stove 2 has four exemplary cooking zones 4 in a cooking field 6. Each cooking zone 4 contains at least one electric heating element 9 under a ceramic plate 8, which can be manually switched on and off and adjusted freely or in increments to desired heat energy with the aid of a manual control 10 on the front side of the stove. The stove can also contain an oven 12.

Disposed above the stove is a fume hood 20, which extends substantially over all four cooking zones 4. The fume hood 20 includes a fan 22 and, downstream of the fan 22 in a steam exhaust path, a steam filter 24 over a screen 26.

A control or regulating device 30 registers the steam that rises from the cooking zones 4 when food is slow-cooked or when liquids (such as soup), vegetables, or water are boiled, and limits, controls, or regulates the heat energy of the cooking zones 4 in dependence upon the registered steam.

The control or regulating device 30 can be disposed at or in the stove 2 or at or in the fume hood 20. The control or regulating device is functionally connected to a sensor device 32 that is disposed in the steam exhaust path of the cooking zones 4, preferably, at or in the fume hood 20. The sensor device 32 generates a signal in dependence upon the registered steam, for instance, in dependence upon the density, flow velocity, or temperature of the steam, or other steam values. One or more of the following additional functions, as well as others, can be provided in the control or regulating device 30 in dependence upon the sensor signal.

First, the device can cut-off or reduce the heat energy of the relevant cooking zone 4 when a predetermined limit value is exceeded, and reactivate the heat energy when the relevant steam value returns below the limit value. Second the device can regulate the heat energy of the relevant cooking zone in dependence upon a predetermined desired value, which can be a fixed value or a variable desired value that is adjustable in dependence upon the manual control element 10. Third, the device can switch operations, or control or regulating operations, in dependence upon the time period within which steam variations are registered by the sensor device 32, for instance, the complete cut-off of heat energy to the relevant cooking zone 4 given an abrupt failure of the steam signals or a drop in the registered steam value below a predetermined value within a short time (e.g., because a pot or pan has been removed from the relevant cooking zone), or given a slow decline in steam development given a constant heat energy setting at the manual control 10 (e.g., because the state may indicate that all water or fat has evaporated, creating the risk of food burning and, thus, the risk of fire). The control or regulating device 30 can be configured to detect the steam variations per unit time, not simply steam variations per se.

The control or regulating device 30 can be constructed with an alarm mechanism for generating an alarm signal when it detects an exceeding of internally prescribed safety criteria.

The sensor device 32 can include an ultrasonic measuring system having an ultrasound transmitter 31 and receiver 33 disposed straight through the steam path.

A separate control or regulating device 30 and/or a separate sensor device 32 can be provided for each cooking zone 4. According to another embodiment, an individually allocated sensor device 32 is disposed above each cooking zone 4 in its steam flow path, but all the sensor devices are electrically connected to one common control or regulating device 30. According to another embodiment, a common sensor device 32 and a common control or regulating device 30 can be provided for a plurality of cooking zones 4. In such a case, depending on the embodiment, the control or regulating device 30 is constructed such that it either successively reduces the heat energy of the cooking locations until it detects which cooking location is responsible for the excess steam, whereupon it reduces only the heat energy of that location accordingly, while leaving the heat energy setting of the other cooking locations at the value set at the control 10, or it detects the cooking location that is responsible for the excess steam additionally or solely by reference to operating criteria (such as the heat energy set at the control 10, the diameter of the relevant cooking location, and/or the length of time for which the individual cooking locations have been on). Selected criteria for detecting the cooking zone 4 that is responsible for the excess steam can also be utilized to determine the cooking zone 4 from which steam suddenly fails to occur or occurs in increasingly smaller quantities despite a constant setting of a specified heat energy at the control 10.

The sensor 32 can be additionally connected to a control or regulating device 34 of the fume hood 20 to switch its fan 22 on or off or to a specified speed in dependence on the respective quantity of cooking steam, as is disclosed in European Patent Application EP 0 443 141 A2, cited above.

Instead of the control or regulating device 30 of the stove, the control or regulating device 34 of the fan 22 of the fume hood 20 can be provided for switching, controlling, and/or regulating the heat energy of the stove 2.

I claim:

1. In a stove having a cooking field with a number of cooking zones, a controller comprising:

a control device connected to the cooking zones;

a common sensor being connected to said control device and being associated with the cooking zones for detecting a level of steam produced at the cooking zones; and said control device influencing an amount of heat energy produced by the cooking zones in dependence upon the level of cooking steam detected.

2. The controller according to claim 1, wherein said control device cuts off the heat energy in dependence upon the level of cooking steam detected.

3. The controller according to claim 1, wherein said control device cuts off the heat energy when a predetermined steam value is detected.

4. The controller according to claim 1, wherein said control device controls the amount of heat energy in dependence upon the level of cooking steam detected.

5. The controller according to claim 1, wherein said control device regulates the amount of heat energy in dependence upon the level of cooking steam detected.

6. The controller according to claim 1, wherein said control device responds to at least one cooking steam value selected from the group consisting of steam quantity/time, steam density, and steam temperature.

7. The controller according to claim 1, wherein said common sensor is disposed above the cooking field in a path of the steam produced by the cooking zones.

8. The controller according to claim 7, wherein:

the stove has a fume hood; and said common sensor is disposed at the fume hood.

9. The controller according to claim 7, wherein:

the stove has a fume hood with a fan; and said sensor is connected to the fan and automatically activates the fan in dependence upon the level of steam detected.

10. The controller according to claim 1, wherein:

said common sensor automatically detects one of the cooking zones responsible for producing steam exceeding a prescribed steam value based upon prescribed operating criteria, and said control device limits heat energy produced by the one cooking zone.

11. The controller according to claim 1, wherein said control device is manually selectively disconnectable from and reconnectable to cooking functions of the stove.

12. The controller according to claim 1, wherein said control device has a selection switch for manual operator disconnection from and reconnection to the stove.

13. The controller according to claim 1, wherein said control device has a safety shut-off automatically cutting off heat energy from the cooking zones dependent upon the level of steam detected and upon at least one prescribed safety criterion when the cooking zones exceed the at least one safety criterion.

14. The controller according to claim 1, wherein:

the stove has a fume hood with a fan; and said control device is connected to the fan and automatically activates the fan in dependence upon the level of steam detected.

15. In a stove having a cooking field with a number of cooking zones, a controller comprising:

a control device connected to the cooking zones;

a common sensor being connected to said control device and being associated with the cooking zones; and said common sensor automatically detecting one of the cooking zones responsible for producing steam exceeding a prescribed steam value, and said control device limiting heat energy produced by serially and selectively reducing heat energy of the cooking zones.

16. In a central home electronic system having a stove with a cooking field including a number of cooking zones, a controller comprising:

a control device connected to the cooking zones and to the central home electronic system;

a common sensor being connected to said control device and being associated with the cooking zones for detecting a level of steam produced at the cooking zones; and said control device influencing an amount of heat energy produced by the cooking zones in dependence upon the level of cooking steam detected, said control device controllable through the central home electronic system.

17. A controller for a stove having a cooking field with a cooking zones, the controller comprising:

a control device connected to the cooking zones;

a common sensor being connected to said control device and being associated with the cooking zones for detecting a level of steam produced at the cooking zones; and said control device influencing an amount of heat energy produced by the cooking zones in dependence upon the level of cooking steam detected.

18. A method for controlling a stove having a cooking field with a number of cooking zones, which comprises:

detecting a level of cooking steam produced from the cooking zones with a common sensor;

controlling the number of cooking zones dependent upon the level of cooking steam detected; and influending, by a control device, a level of heat energy of the cooking zones in dependence upon the level of cooking steam detected.

* * * * *